US009056699B2

(12) United States Patent
Crosby

(10) Patent No.: US 9,056,699 B2
(45) Date of Patent: Jun. 16, 2015

(54) POURING SPOUT FOR CONTAINER

(71) Applicant: FunLPro Technology LLC, Maryville, TN (US)

(72) Inventor: Bryan Justin Robert Crosby, Maryville, TN (US)

(73) Assignee: FunLPro Technology LLC, Maryville, TN (US)

( * ) Notice: Subject to any disclaimer, the term of this patent is extended or adjusted under 35 U.S.C. 154(b) by 46 days.

(21) Appl. No.: 13/833,004

(22) Filed: Mar. 15, 2013

(65) Prior Publication Data

US 2013/0270307 A1 Oct. 17, 2013

Related U.S. Application Data

(60) Provisional application No. 61/623,536, filed on Apr. 12, 2012.

(51) Int. Cl.

| | |
|---|---|
| ***B67D 3/00*** | (2006.01) |
| ***B65D 47/06*** | (2006.01) |
| ***B65D 47/08*** | (2006.01) |
| ***B65D 51/20*** | (2006.01) |

(52) U.S. Cl.

CPC ..... *B65D 47/063* (2013.01); *B65D 47/0885* (2013.01); *B65D 51/20* (2013.01); *B65D 2251/0025* (2013.01); *B65D 2251/0093* (2013.01)

(58) Field of Classification Search

CPC ..... B67D 3/00; B67D 7/06; B65D 5/72
USPC ..... 222/526–537, 566–570, 523, 539
See application file for complete search history.

(56) References Cited

U.S. PATENT DOCUMENTS

| | | | | |
|---|---|---|---|---|
| 1,473,925 | A * | 11/1923 | Dryer | 222/523 |
| 1,595,231 | A * | 8/1926 | Dryer | 222/523 |
| 3,865,270 | A * | 2/1975 | Petersson | 220/721 |

(Continued)

FOREIGN PATENT DOCUMENTS

| | | |
|---|---|---|
| DE | 9111483 U1 | 1/1992 |
| EP | 0353043 A2 | 1/1990 |

(Continued)

OTHER PUBLICATIONS

International Search Report and Written Opinion for International Application No. PCT/US2013/035878 mailed Jun. 10, 2013.

*Primary Examiner* — Paul R Durand
*Assistant Examiner* — Andrew P Bainbridge
(74) *Attorney, Agent, or Firm* — Sutherland Asbill & Brennan LLP

(57) ABSTRACT

A cap for a container is provided. The cap includes a handling portion that is configured to engage the container about a dispensing opening of the container. The cap also includes an extendible spout that has a discharge passage. The extendible spout has a proximal end, with a proximal opening, and is affixed to the cap. The extendible spout also has a distal end, with a distal opening, and is configured to extend from and retract at least partially into the cap. The extendible spout is further configured to dispense a pourable material from the container through the distal opening when the handling portion is engaged with the container about the dispensing opening of the container and the distal end of the extendible spout is at least partially extended from the cap.

20 Claims, 6 Drawing Sheets

(56) References Cited

U.S. PATENT DOCUMENTS

| | | | | | |
|---|---|---|---|---|---|
| 4,426,027 | A | * | 1/1984 | Maynard, Jr. | 222/529 |
| 4,452,382 | A | * | 6/1984 | Von Holdt | 222/529 |
| 4,560,081 | A | * | 12/1985 | Adams | 222/529 |
| 5,088,632 | A | | 2/1992 | Odet et al. | |
| 6,006,961 | A | * | 12/1999 | Wark | 222/527 |
| 6,112,949 | A | * | 9/2000 | Rhodes et al. | 222/153.02 |
| 6,386,405 | B1 | | 5/2002 | Kars et al. | |
| 7,980,431 | B1 | * | 7/2011 | Barksdale | 222/530 |
| 2009/0212079 | A1 | | 8/2009 | Baughman et al. | |

FOREIGN PATENT DOCUMENTS

| | | | |
|---|---|---|---|
| EP | 1864915 | A2 | 12/2007 |
| EP | 2371730 | A1 | 10/2011 |
| FR | 2388730 | A1 | 11/1978 |
| FR | 2895732 | A1 | 7/2007 |
| WO | 00/16668 | A1 | 3/2000 |

* cited by examiner

POURING SPOUT FOR CONTAINER

CROSS REFERENCE TO RELATED APPLICATIONS

This application claims priority to U.S. Provisional Patent Application No. 61/623,536 filed on Apr. 12, 2012, the disclosure of which is incorporated in full herein by reference.

TECHNICAL FIELD

The present disclosure relates generally to containers and, more particularly, to pouring spouts for containers.

BACKGROUND

Typically, when transferring fluids from a container, it is necessary either to attach a pouring spout to the container or to insert a funnel into the receiving vessel to prevent unwanted spillage. Such transfer methods are commonly used to deliver fluids such as motor oil, antifreeze, transmission fluid, and gasoline additives to an automobile. A common problem when using transfer devices such as a pouring spout or a funnel to transfer such fluids is that a user must locate, clean, and dry the transfer device to avoid contamination of the fluid during transfer to the receiving vessel. The user must also select a transfer device of an appropriate size and shape to enable the transfer of fluids without spillage.

Thus, there is a need for an improved pouring spout for a container to facilitate the easy and clean transfer of pourable materials from a container.

SUMMARY

In one aspect, a cap for a container is provided. The cap includes a handling portion that is configured to engage the container about a dispensing opening of the container. The cap also includes an extendible spout that has a discharge passage. The extendible spout has a proximal end, with a proximal opening, and is affixed to the cap. The extendible spout also has a distal end, with a distal opening, and is configured to extend from and retract at least partially into the cap. The extendible spout is further configured to dispense a pourable material from the container through the distal opening when the handling portion is engaged with the container about the dispensing opening of the container and the distal end of the extendible spout is at least partially extended from the cap.

In another aspect, a material container is provided. The material container includes a container with a dispensing opening. A cap is connected to the container about the dispensing opening of the container. The cap comprises a handling portion that is configured to engage the container about the dispensing opening of the container. The cap also includes an extendible spout with a discharge passage. The extendible spout has a proximal end, with a proximal opening, that is affixed to the cap. The extendible spout further has a distal end, with a distal opening, and is configured to extend from and retract at least partially into the cap. The extendible spout is configured to dispense a pourable material from the container through the distal opening when the handling portion is engaged with the container about the dispensing opening of the container and the distal end of the extendible spout is at least partially extended from the cap.

Additional aspects will be set forth in part in the description that follows, and in part will be obvious from the description, or may be learned by practice of the aspects described below.

The advantages described below will be realized and attained by means of the elements and combinations particularly pointed out in the appended claims. It is to be understood that both the foregoing general description and the following detailed description are exemplary and explanatory only and are not restrictive.

BRIEF DESCRIPTION OF THE DRAWINGS

These and other features, aspects, and advantages of the present invention will become better understood when the following detailed description is read with reference to the accompanying drawings, wherein.

Figure 1:
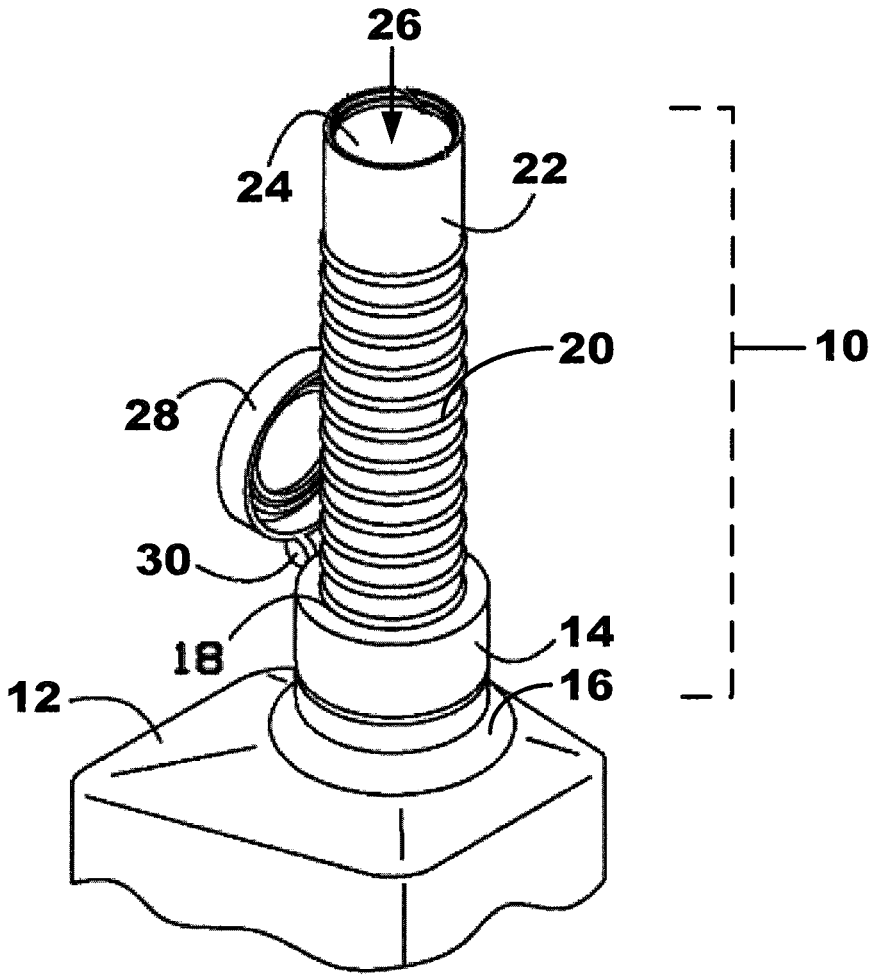
FIG. 1 is a partial perspective view of a container with an extendible spout positioned in an expanded configuration, in accordance with embodiments of the present disclosure.

Corresponding reference characters indicate corresponding parts throughout the several Figures. The exemplifications set out herein illustrate embodiments of the invention, sometimes in one form, and such exemplification should not be construed as limiting the scope of the claimed invention in any manner.

DETAILED DESCRIPTION

In the following description, numerous specific details are given to provide a thorough understanding of embodiments. The embodiments can be practiced without one or more of the specific details, or with other components, materials, etc. In other instances, well-known structures, materials, or operations are not shown or described in detail to avoid obscuring aspects of the embodiments.

Reference throughout this specification to "one embodiment," "an embodiment," or "embodiments" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 3:
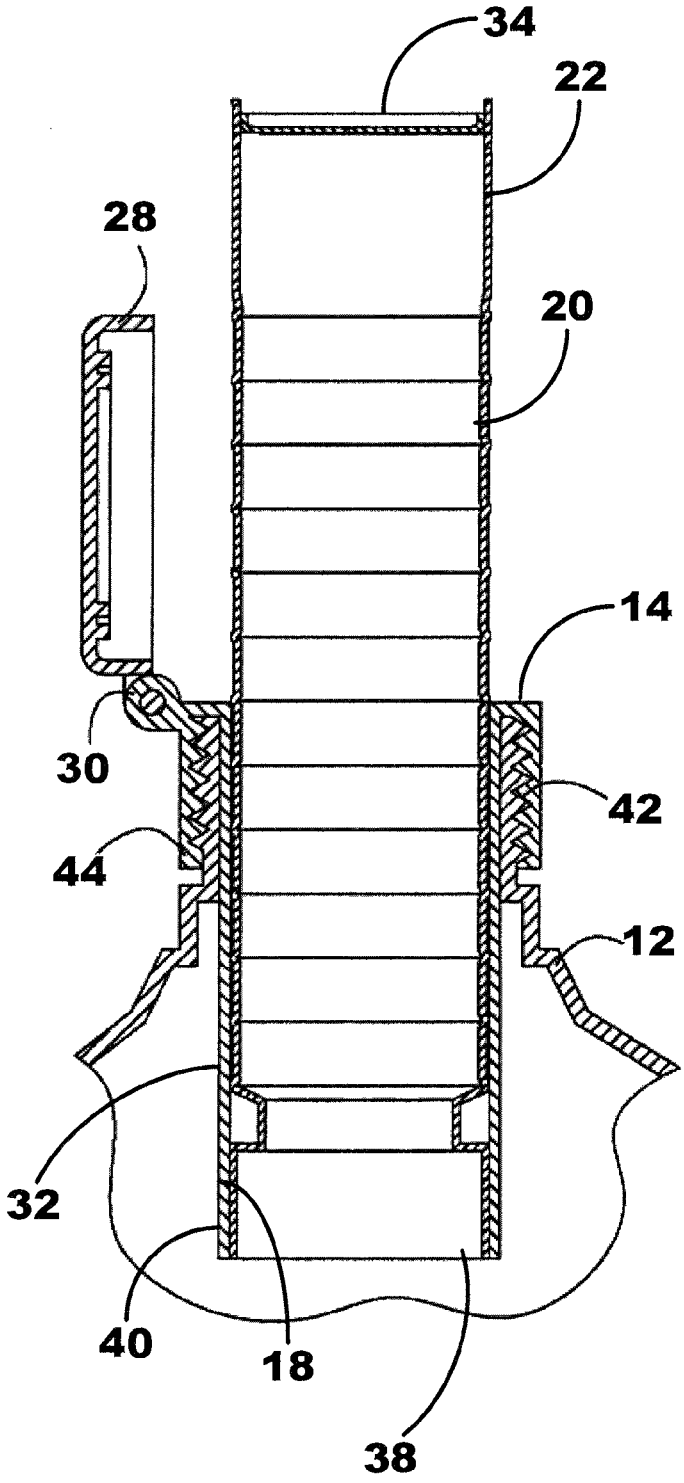
FIG. 3 is a cross-sectional view of the container of FIG. 1 with the extendible spout in an expanded configuration, in accordance with embodiments of the present disclosure.

Referring now to the drawings, and more particularly to FIG. 1, there is illustrated a pourable material dispensing system 100 including a cap 10 connected to a container 12. A handling portion 14 of the cap 10 may be engaged to the container 12 about a dispensing opening 16. A proximal end 18 of an extendible spout 20 may be connected to the handling portion 14 of the cap 10, where the proximal end 18 of the extendible spout has a proximal opening 38 (as depicted in FIG. 3) that is in fluid communication with the contents of container 12. A distal end 22 of the extendible spout 20 is configured to extend from and retract at least partially into the handling portion 14 of the cap 10. The distal end 22 of the extendible spout includes a distal opening 24. The distal opening 24 of the extendible spout 20 is configured to dispense a pourable material from the container 12 when the handling portion 14 is engaged with the container 12 about the dispensing opening 16.

In operation, the extendible spout 20 is at least partially extended from the cap 10. The pourable material from the container 12 may enter the extendible spout 20 through the proximal opening 38 (as depicted in FIG. 3) at the proximal end 18 of the extendible spout 20, pass through a discharge passage 26 contained within the extendible spout 20 and extending from the proximal opening 38 to the distal opening 24, and exit the extendible spout 20 through the distal opening 24.

As shown in FIG. 1, the extendible spout 20 may be fully extended from the cap 10. In other embodiments, the extendible spout 20 may only be partially extended from the cap 10. In some embodiments, the handling portion 14 may be connected to a lid 28. When the extendible spout 20 is at least partially extended from the cap 10, the lid 28 is in an open position. In other embodiments, the lid 28 may be hingedly connected to the handling portion 14 via a hinge 30.

Figure 2:
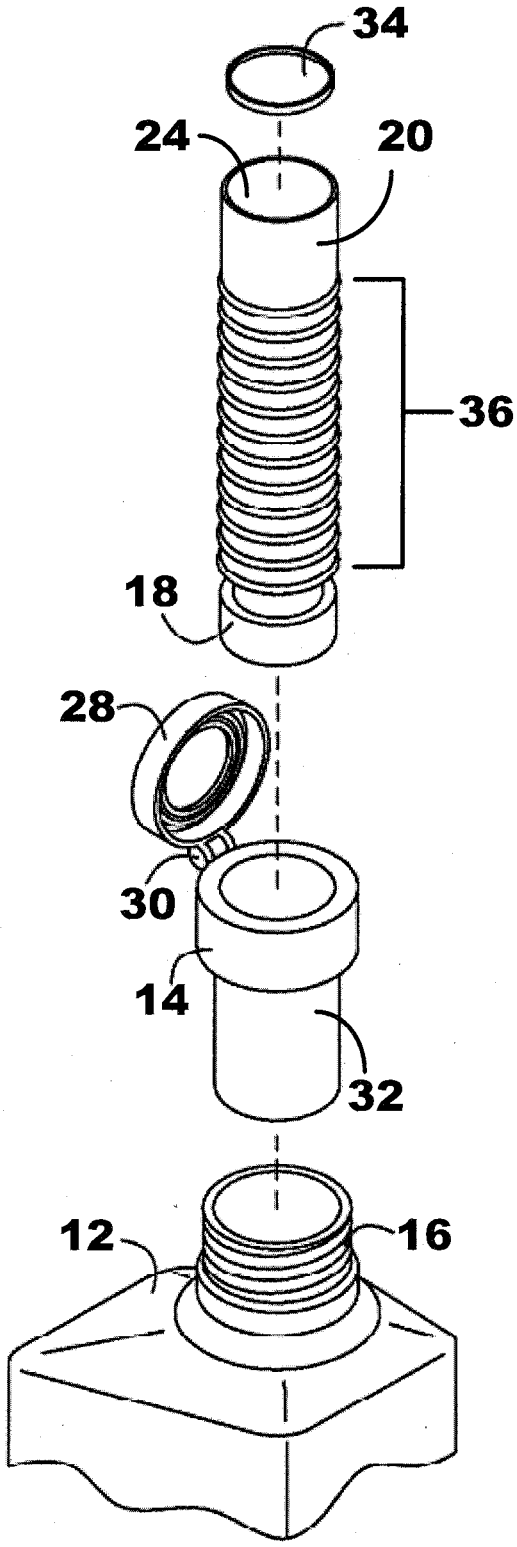
FIG. 2 is an exploded view of the container of FIG. 1, in accordance with embodiments of the present disclosure.

Referring now to FIG. 2, the handling portion 14 may further include a hollow rigid member 32 that is configured to fit into the dispensing opening 16 of the container 12 when the handling portion 14 is engaged with the dispensing opening 16 of container 12. The hollow rigid member 32 permits the flow of pourable material into the discharge passage 26 contained within the extendible spout 20. In some embodiments, the hollow rigid member 32 may extend further beyond the dispensing opening 16 and into the container 12. In some embodiments, the hollow rigid member 32 may comprise a thermoplastic, including but not limited to polypropylene and polyethylene, and may be formed by injection molding. In other embodiments, both the hollow rigid member 32 and the handling portion 14 may comprise a thermoplastic such as polypropylene or polyethylene and may be formed by injection molding.

In some embodiments, the extendible spout 20 may comprise a corrugated portion 36 made from a thermoplastic material that allows for a robust expandability and flexibility of the extendible spout 20. In some embodiments, the extendible spout 20 may comprise a thermoplastic, including but not limited to polypropylene and polyethylene, and may be formed by extrusion molding. In still other embodiments, both the extendible spout 20 and the corrugated portion 36 may comprise polypropylene or polyethylene and may be formed by extrusion molding. In yet another embodiment, the extendible spout 20, including the corrugated portion 36, may comprise a paper coated with a plastic or a wax layer. In still other embodiments, either the extendible spout 20 or the corrugated portion 36 may comprise a paper coated with a plastic or a wax layer.

Figure 4:
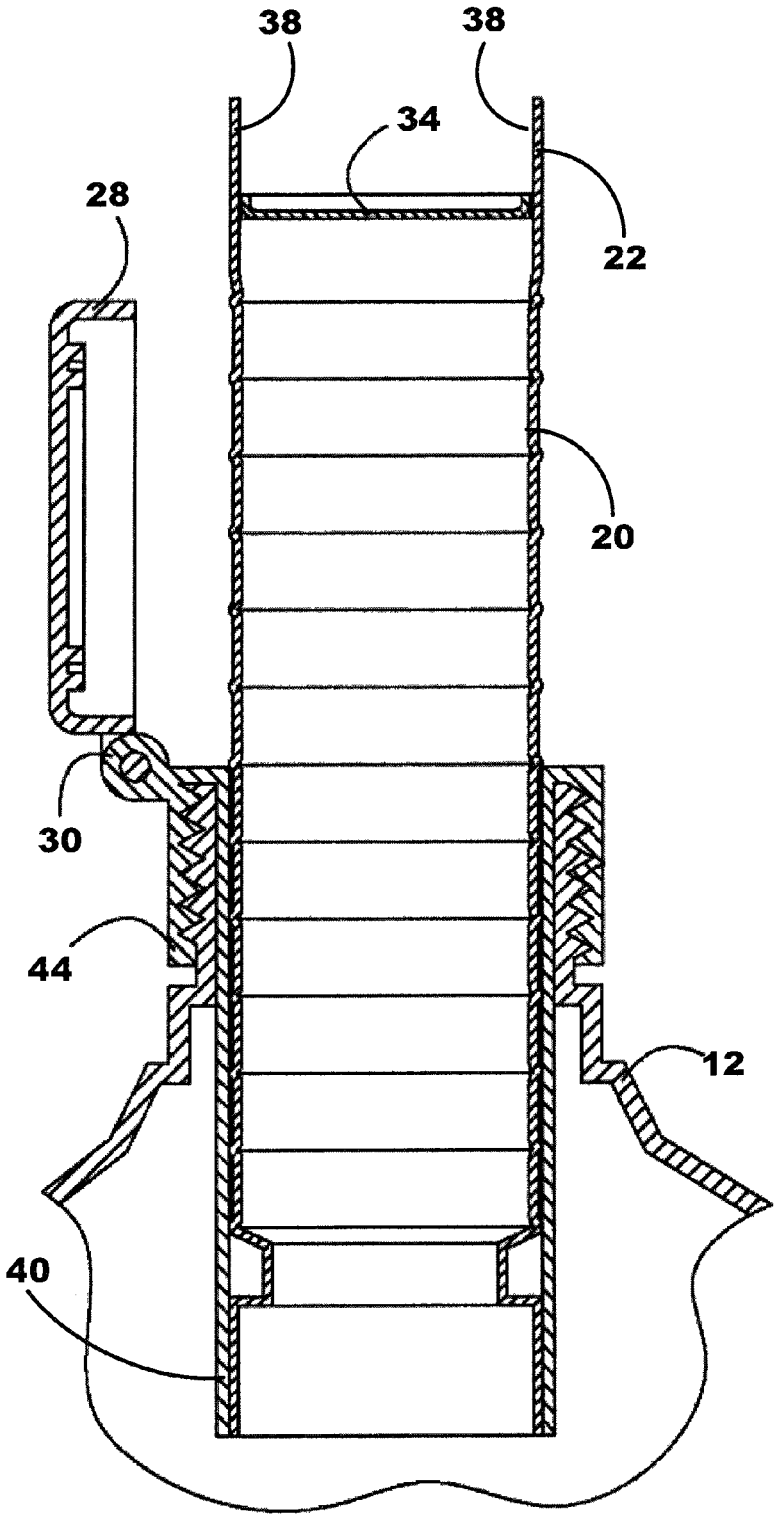
FIG. 4 is a cross-sectional view of a variation of the container of FIG. 1 with the extendible spout in an expanded configuration, in accordance with embodiments of the present disclosure.

Turning now to FIG. 3, in certain embodiments the distal opening 24 of the extendible spout 20 may be covered or sealed with a removable safety seal 34. Referring now to FIG. 4, in other embodiments, the distal end 22 of the extendible spout 20 may instead contain a removable safety seal 34, where the removable safety seal 34 is not connected at the distal opening 24 but is instead connected to the inner walls 38 of the extendible spout 20 to block the discharge passage. In some embodiments, more than one removable safety seal 34 may be used. For instance, in an embodiment the distal opening 24 of the extendible spout 20 may be sealed with a first removable safety seal 34 and the inner walls 38 of the extendible spout 20 may be sealed with a second removable seal 34. In yet other embodiments, the removable safety seal 34 may instead be connected to and cover the proximal end 18 of the extendible spout 20. In other embodiments, the removable safety seal 34 may be located adjacent to the proximal end 18 of the extendible spout 20.

The safety seal 34 may comprise a metal foil that is coated with plastic layer, wherein the plastic layer faces the direction of the discharge passage. In some embodiments, the metal foil may comprise an aluminum foil or a platinum foil. In certain embodiments, the safety seal 34 may be heat sealed to either the distal opening 24 or the inner walls 38 of the extendible spout 20 for attachment. In some embodiments, the safety seal 34 may punctured for removal. In other embodiments, the safety seal 34 may further include a pull tab to enable a user to remove the safety seal 34 with a pealing motion.

Turning back to FIG. 3, the proximal end 18 of the extendible spout 20 may be affixed to an inner surface 40 of the hollow rigid member 32. Such an attachment would be secure enough enable the extendible spout 20 to be extended and retracted from the cap 10 without the extendible spout 20 becoming disengaged from the cap 10. In embodiments, the extendible spout 20 may be affixed to the inner surface 40 using a bonding method, including but not limited to adhesive gluing or sonic welding. As depicted in FIG. 3, the extendible spout 20 may extend from the hollow rigid member 32 of the handling portion 14. In embodiments, the extendible spout 20 is selectively positionable and may be in an expanded configuration in which the extendible spout 20 is expanded and the distal end 22 extends out of cap 10.

In some embodiments, the diameter of the hollow rigid member 32 may be less than the diameter of the dispenser opening 16. In other embodiments, the diameter of the hollow rigid member may be substantially the same as the diameter of the dispenser opening 16. In still other embodiments, the diameter of the hollow rigid member 32 may be greater than the diameter of the dispenser opening 16.

The container 12 may comprise a threaded fitment 44. In some embodiments, the dispensing opening 16 of the container 12 includes the threaded fitment 44. The handling portion 14 may include a threading 42 that is configured to engage the threaded fitment 44 and thus secure the cap 10 to the container 12. In some embodiments, the handling portion 14 may instead include a single threading tooth that is designed to snap onto the threaded fitment 44. The threading 42 of the handling portion 14 may be configured with different threadings to enable the cap 10 to be fitted to a variety of containers with different threaded fitments. In alternate embodiments, the container 12 may not include a threaded fitment 44 and the handling portion 14 may not contain a threading 42. In such an embodiment, the handling portion 14 instead may be attached to the dispensing opening 16 of a container 12 using another method, including but not limited to adhesion, friction coupling, or clamping.

In still other embodiments, threadings may be positioned on the exterior wall of the hollow rigid member 32. In such embodiments, the threads on the outside of the hollow rigid member 32 may be configured to engage threads on the inside of dispenser opening 16.

Figure 5:
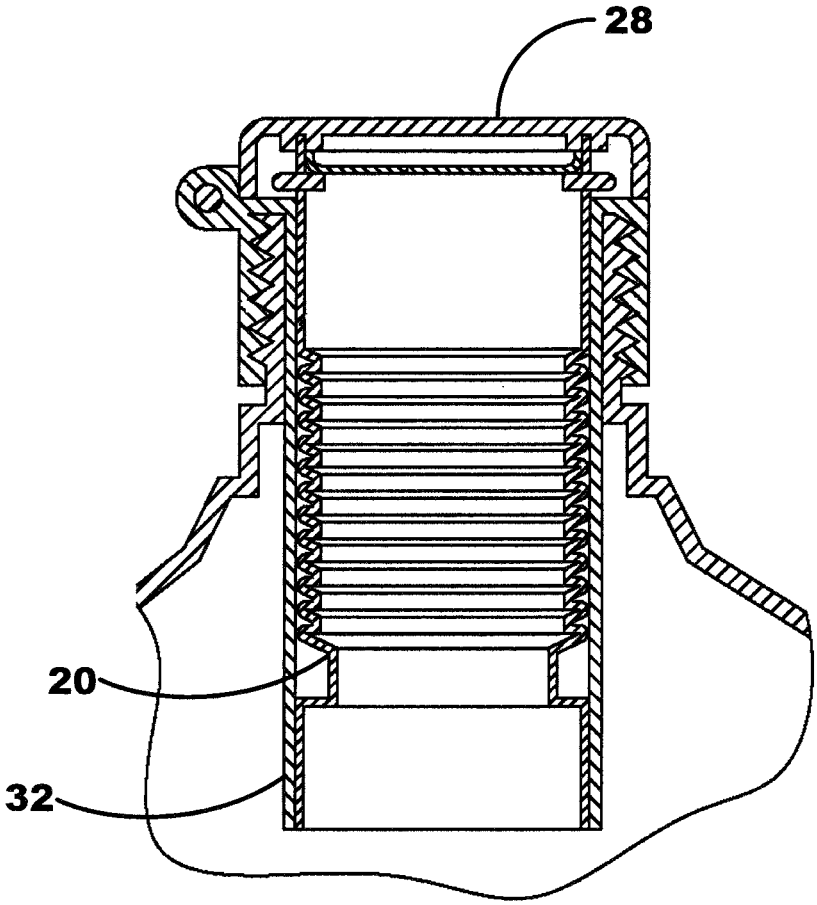
FIG. 5 is a cross-section view of the container of FIG. 1 with the extendible spout in a collapsed configuration, in accordance with embodiments of the present disclosure.

FIG. 5 shows an extendible spout 20 that is retracted into the hollow rigid member 32 of the handling portion 14. In this configuration, the extendible spout 20 is selectively positioned in a collapsed configuration with the distal end 22 of the extendible spout 20 disposed within the handling portion 14 (and therefore within the cap 10). In other embodiments, the extendible spout 20 may be selectively positioned in a partially collapsed position, where a portion of the extendible spout 20 extends out of the handling portion 14. In some embodiments, a user may insert a finger into the distal end 22 of the extendible spout 20 to adjust the length the extendible spout 20.

Figure 6:
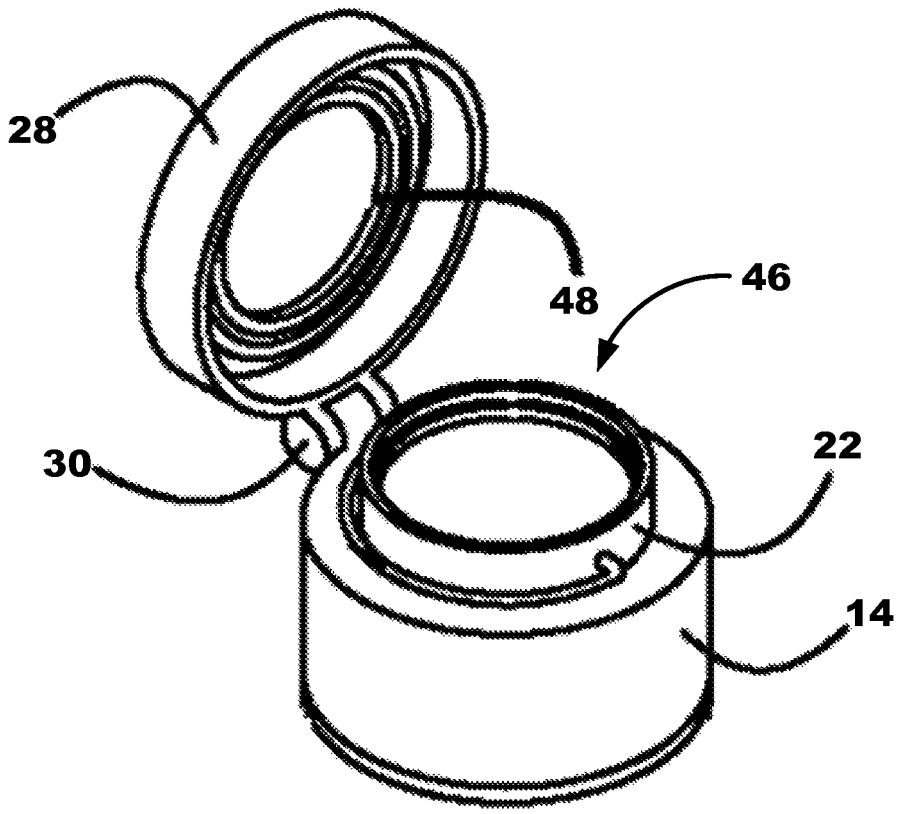
FIG. 6 is a perspective view of the handling portion, the extendible spout, and the lid, in accordance with embodiments of the present disclosure.

When the extendible spout 20 is completely retracted into the hollow rigid member 32 of the handling portion 14, lid 28 may be used to removably cover the top of the handling portion 14. FIG. 6 shows a discharge opening 46 of the handling portion 14. In some embodiments, lid 28 may removably cover the discharge opening 46 when the distal end 22 of the extendible spout 20 is retracted. In some embodiments, the inner portion of lid 28 may include a circular groove 48 that is configured to releasably engage the distal end 22 of the extendible spout 20 that may slightly protrude from the handling portion 14. In still other embodiments, lid 28 may include a tab that extends from the lid 28 to enable a user to remove the lid 28 from the handling portion 14. In embodiments, the lid 28 may also be releasably secured to the handling portion 14 with a clamp fastener, a snap fastener, or a friction fit.

In some embodiments, the inner walls 38 of the distal portion 22 of the extendible spout 20 may have grooves configured to aid a user in extending the extendible spout 20. In other embodiments, the inner walls 38 of the distal portion 22 of the extendible spout 20 may have dimples to aid a user in extending the extendible spout 20. In still other embodiments, the distal portion 22 of the extendible spout 20 may have a lip or ridge, located on the inner surface or outer surface or both surfaces of the distal portion 22 of the extendible spout 20. The lip or ridge may be similarly configured to aid a user in extending the extendible spout 20.

In still other embodiments, the lid 28 may comprise inner threads configured to engage outer threads disposed on the distal end 22 of the extendible spout 20. In other embodiments, the lid 28 may have a diameter that is greater than the diameter of the handling portion 14. In such embodiments, the lid 28 may comprise inner threads configured to engage outer threads that may be disposed around the outer periphery of the handling portion 14.

In some embodiments the pourable material may be a fluid. In some embodiments, the pourable material may be a liquid. In embodiments, the liquid may be a viscous fluid such as motor oil. In other embodiments, the pourable material may be flowable solid. In some embodiments, the flowable solid may be sand or pebbles.

It should be apparent that the foregoing relates only to the preferred embodiments of the present invention and that numerous changes and modifications may be made herein without departing from the spirit and the scope of the invention as defined by the following claims and equivalents thereof.

I claim:

1. A cap for a container comprising:

a handling portion configured to engage the container about a dispensing opening of the container, the handling portion comprising a hollow rigid member that fits into and extends beyond the dispensing opening and into the container when the handling portion is engaged with the container; and an extendible spout having a discharge passage and comprising:

a proximal end bonded to an inner surface of the hollow rigid member and having a proximal opening; and a distal end configured to extend from and retract at least partially into the hollow ridge member and having a distal opening, wherein the extendible spout is configured to dispense a pourable material from the container through the distal opening when the handling portion is engaged with the container about the dispensing opening of the container and the distal end of the extendible spout is at least partially extended from the cap, and wherein the extendible spout is selectively positioned in a collapsed configuration in which the extendible spout is collapsed and the distal end is at least partially disposed within the hollow rigid member, and, alternatively, an expanded configuration in which the extendible spout is expanded and the distal end extends out of the hollow rigid member.

2. The cap of claim 1, wherein the extendible spout is flexible.

3. The cap of claim 1, wherein the container comprises a threaded fitment, the dispensing opening of the container is within the threaded fitment, and the handling portion further comprises a threading adapted to engage the threaded fitment.

4. The cap of claim 1, wherein the handling portion has a discharge opening and the cap further comprises a lid adapted to removably cover the discharge opening of the handling portion when the distal end of the extendible spout is retracted into the hollow rigid member.

5. The cap of claim 4, wherein the lid is hingedly connected to the handling portion.

6. The cap of claim 1, wherein the pourable material is a fluid.

7. The cap of claim 1, further comprising a removable safety seal covering the distal opening of the extendible spout.

8. The cap of claim 1, wherein the inner walls of the distal end of the extendible spout comprise grooves or dimples to aid a user in extending the extendible spout from the hollow rigid member.

9. The cap of claim 1, wherein the distal end further includes a lip or ridge located on at least one of the inner or outer surfaces of the distal end.

10. The cap of claim 4, wherein the lid comprises a tab that extends from the lid to enable a user to remove the lid from the handling portion.

11. A material container comprising:

a container including a dispensing opening; and a cap connected to the container about the dispensing opening of the container, the cap comprising:

a handling portion configured to engage the container about the dispensing opening of the container, the handling portion comprising a hollow rigid member that fits into and extends beyond the dispensing opening and into the container when the handling portion is engaged with the container; and an extendible spout having a discharge passage and comprising:

a proximal end bonded to an inner surface of the hollow rigid member and having a proximal opening; and a distal end configured to extend from and retract at least partially into the hollow rigid member and having a distal opening, wherein the extendible spout is configured to dispense a pourable material from the container through the distal opening when the handling portion is engaged with the container about the dispensing opening of the container and the distal end of the extendible spout is at least partially extended from the cap, and wherein the extendible spout is selectively positioned in a collapsed configuration in which the extendible spout is collapsed and the distal end is at least partially disposed within the hollow rigid member, and, alternatively, an expanded configuration in which the extendible spout is expanded and the distal end extends out of the hollow rigid member.

12. The material container of claim 11, wherein the extendible spout is flexible.

13. The material container of claim 11, wherein the container comprises a threaded fitment, the dispensing opening of the container is within the threaded fitment, and the handling portion further comprises a threading adapted to engage the threaded fitment.

14. The material container of claim 11, wherein the handling portion has a discharge opening and the cap further comprises a lid adapted to removably cover the discharge opening of the handling portion when the distal end of the extendible spout is refracted into the hollow rigid member.

15. The material container of claim 14, wherein the lid is hingedly connected to the handling portion.

16. The material container of claim 11, wherein the pourable material is a fluid.

17. The material container of claim 11, further comprising a removable safety seal covering the distal opening of the extendible spout.

18. The cap of claim 11, wherein the inner walls of the distal end of the extendible spout comprise grooves or dimples to aid a user in extending the extendible spout from the hollow rigid member.

19. The cap of claim 11, wherein the distal end comprises a lip or ridge located on at least one of the inner or outer surfaces of the distal end.

20. The cap of claim 14, wherein the lid comprises a tab that extends from the lid to enable a user to remove the lid from the handling portion.

* * * * *

UNITED STATES PATENT AND TRADEMARK OFFICE

CERTIFICATE OF CORRECTION

PATENT NO. : 9,056,699 B2
APPLICATION NO. : 13/833004
DATED : June 16, 2015
INVENTOR(S) : Bryan Justin Robert Crosby It is certified that error appears in the above-identified patent and that said Letters Patent is hereby corrected as shown below:

In the claims

In claim 14 (column 7, line 15), please change “is refracted” to -- is retracted --.

Signed and Sealed this
Third Day of November, 2015

Michelle K. Lee

Michelle K. Lee
*Director of the United States Patent and Trademark Office*